United States Patent [19]

Dean, III et al.

[11] 4,189,027

[45] Feb. 19, 1980

[54] SOUND SUPPRESSOR LINERS

[75] Inventors: Lee W. Dean, III, South Glastonbury; Aldo A. Peracchio, South Windsor, both of Conn.

[73] Assignee: United Technologies Corporation, Hartford, Conn.

[21] Appl. No.: 860,040

[22] Filed: Dec. 12, 1977

Related U.S. Application Data

[62] Division of Ser. No. 715,816, Aug. 19, 1976.

[51] Int. Cl.[2] ..... F01N 1/00; E04B 1/99; G10K 11/04

[52] U.S. Cl. ..... 181/286; 181/288; 181/292; 181/293; 428/116; 428/131

[58] Field of Search ..... 181/284, 286, 288, 292, 181/293, 213, 214, 222, 224, 290

[56] References Cited

U.S. PATENT DOCUMENTS

| | | | |
|---|---|---|---|
| 2,062,478 | 12/1936 | Riesz | 181/288 |
| 2,281,121 | 4/1942 | Straight | 52/145 |
| 2,922,201 | 1/1960 | Baker | 52/481 |
| 2,989,136 | 6/1961 | Wohlberg | 181/224 |
| 3,137,364 | 6/1964 | Akerson | 181/290 |
| 3,177,970 | 4/1965 | Boschi | 181/290 |
| 3,542,152 | 11/1970 | Adamson et al. | 181/222 |
| 3,640,357 | 2/1972 | Kitching et al. | 181/292 |
| 3,819,007 | 6/1974 | Wirt et al. | 181/286 |
| 3,819,009 | 6/1974 | Motsinger | 428/116 |
| 3,820,628 | 6/1974 | Hanson | 181/214 |
| 3,850,261 | 11/1974 | Hehmann | 181/286 |
| 3,910,374 | 10/1975 | Holehouse | 428/116 |
| 4,001,473 | 1/1977 | Cook | 428/131 |

*Primary Examiner*—Stephen J. Tomsky
*Attorney, Agent, or Firm*—Norman Friedland

[57] ABSTRACT

This invention relates to acoustic liners having a plurality of cavities defining Helmholtz resonators in which the adjacent cavities are asymmetrical causing a pressure imbalance across the coupling means (tube, slot or aperture) between these cavities in the frequency range of interest. Such liners are particularly useful in turbofan engine noise reduction applications where low frequencies are encountered.

2 Claims, 4 Drawing Figures

FIG. 1 PRIOR ART
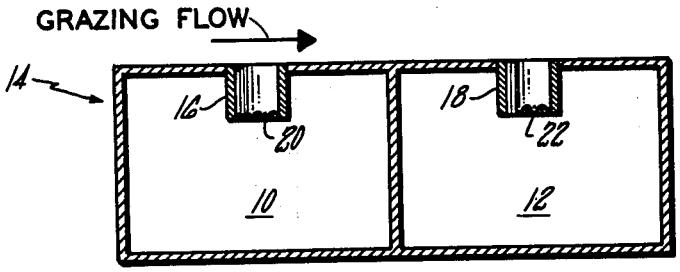
FIG. 2
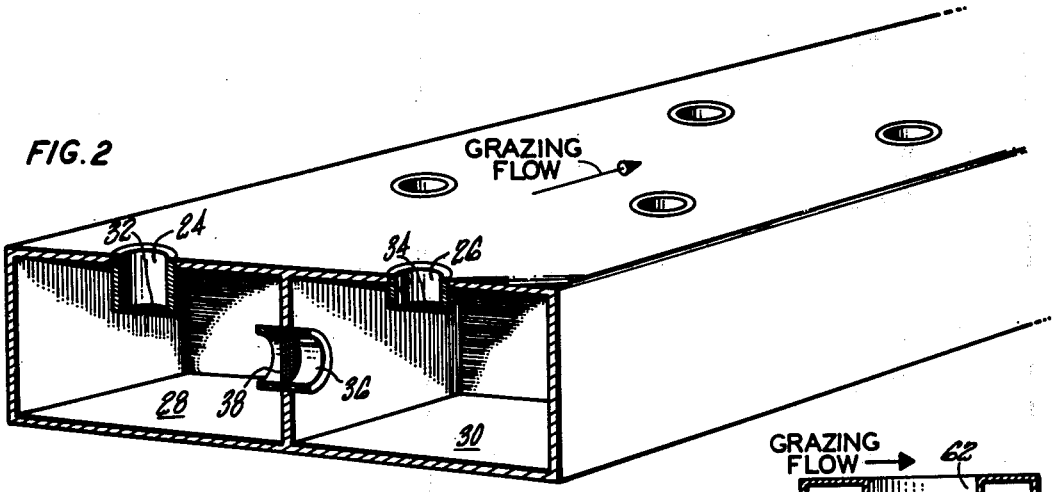
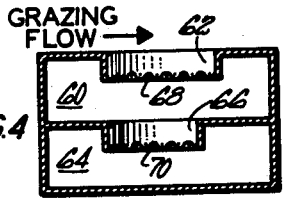
FIG. 4
FIG. 3
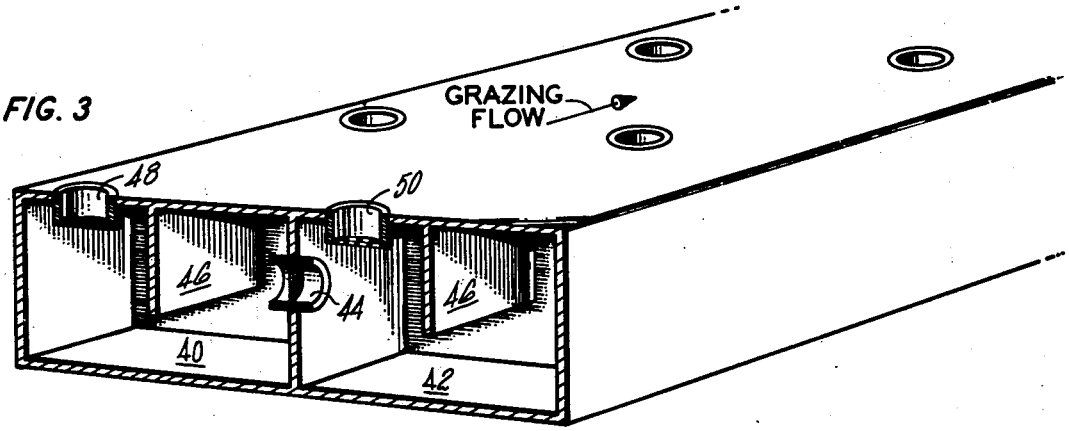

SOUND SUPPRESSOR LINERS

This is a division of application Ser. No. 715,816, filed Aug. 19, 1976.

BACKGROUND OF THE INVENTION

This invention relates to acoustical liners designed to absorb sound energy in the low frequency range and particularly adaptable for turbofan engines.

This invention can best be appreciated by referring to FIG. 1 exemplifying the prior art showing only two adjacent cavities included in an array of cavities and the tubes communicating the grazing flow internally thereof. A resistive element may be located at the inner end of the tube as shown or elsewhere in the tube and the cavities, tubes and resistive elements all being sized for maximum sound absorption for the application for which it is intended to be used. In this type of configuration the design of a liner for a particular frequency range is somewhat limited inasmuch as the optimum impedance value for only one frequency is attainable, such that the maximum energy absorption may not be achieved.

We have obviated this problem and obtained an improved liner with increased flexibility in the design of the liner configuration over a range of frequencies by acoustically coupling two or more adjacent cavities. The adjacent cavities are asymmetrical either by virtue of cavity arrangement, opening configuration or resistive material such that pumping air results in the interconnecting opening between adjacent cavities wherein additional dissipation of sound energy is evidenced. This provides for additional optimum impedance values at two or more frequencies, which when taken into consideration affords greater sound absorption and flexibility in the design of the liner. As a result this invention affords a reduction of the size of the suppressor device required to absorb a given amount of sound energy. Such a device is particularly important in a turbofan engine application for supressing low frequency sound where space and weight are critical parameters.

SUMMARY OF THE INVENTION

An object of this invention is to provide improved sound suppression liners.

A still further object of this invention is to provide improved sound suppression liners of the type described characterized by reducing the size of the liner capable of absorbing a given amount of sound energy in a low frequency range which includes the frequency spectrum envisioned in a turbofan engine.

A still further object of this invention is to couple Helmholtz resonator type liners by interconnecting asymmetrical adjacent cavities by a given opening such that pumping of air therein results when a sound field is present. Asymmetry may be achieved by judicious sizing of the cavity openings or geometric arrangement of the cavities relative to said openings.

Other features and advantages will be apparent from the specification and claims and from the accompanying drawings which illustrate an embodiment of the invention.

BRIEF DESCRIPTION OF THE DRAWINGS

FIG. 1 is a schematic illustrating the prior art acoustical liner.

FIG. 2 is a perspective, partly in section, showing an embodiment of the invention.

FIG. 3 is another perspective, partly in section, showing another embodiment of the invention.

FIG. 4 is another embodiment showing, in section, the inventive concept when the cavities are mounted in series rather than in parallel.

DESCRIPTION OF THE PREFERRED EMBODIMENT

As noted from the prior art construction shown in FIG. 1 the adjacent cavities 10 and 12 of liner 14 is a hard back wall liner construction communicates with the grazing flow through inlet tubes 16 and 18 respectively. A resistive material 20 and 22 may be disposed in tubes 16 and 18 to optimize the Helmholtz resonator. Each cavity (and each liner will include an array of such cavities) is symmetrical, as is the location and size of tubes 16 and 18; it being noted there is no cross communication between cavities.

According to the present invention, as best seen from FIG. 2, the array of cavities (only two being shown) include tubes 24 and 26 communicating the grazing flow with cavities 28 and 30, respectively, and each may have resistive material 32 and 34 mounted thereacross. As will be apparent to one skilled in this art the inlet may be slots or apertures depending on the application, material and size of the walls of the liner. Tubes 24 and 26 are sized differently one being longer than the other to achieve the asymmetrical arrangement so as to create a pressure unbalance across coupling tube 36 interconnecting cavities 28 and 30. A resistive material or screen 38 may be disposed in coupling tube 36. Thus, when a sound field is present the pumping of air in tube 38 resulting from the imbalance of pressure causes dissipation of sound energy.

FIG. 3 is another embodiment of this invention achieving like results but obtaining the asymmetry by the geometrical construction of the cavities.

Hence, as noted in FIG. 3 cavity 40 is folded so that the bottom thereof communicates with the top of adjacent cavity 42 via coupling tube 44. Elongated plates 46 extended partway in the cavities and serve to fold the cavities. Coupling tube 44 as well as inlet tubes 48 and 50 are all similar to those described in FIG. 2 except, as noted, inlet tubes 48 and 50 are the same size.

FIG. 4 is still another embodiment of asymmetrical cavities defining Helmholtz resonators where each of the adjacent cavities are coupled to achieve the same results as described in connection with FIGS. 1 to 3. As can be seen by FIG. 4, the cavity 60 formed in the upper layer of the array of cavities (not shown) communicates with the grazing flow through tube 62. Cavity 60 is coupled to cavity 64 through the tube 66. Note that each cavity and its tube form a Helmholtz resonator. Resistive material 68 and 70 may be disposed in tubes 62 and 66 respectively depending on the particular design criteria.

Asymmetry is obtained in the embodiment of FIG. 4 by making the diameter of tube 62 and 66 dissimilar. Obviously other ways of obtaining asymmetry is contemplated within the scope of the invention.

As one skilled in this art will appreciate although three embodiments of acoustically coupled asymmetric cavities were disclosed there are countless other configurations that can be utilized without departing from the scope of this invention.

It should be understood that the invention is not limited to the particular embodiments shown and described herein, but that various changes and modifications may be made without departing from the spirit or scope of this novel concept as defined by the following claims.

We claim:

1. A sound absorbing liner having a plurality of cells each defining an enclosed cavity, each of said cavities being enclosed by side walls, top wall and bottom wall, the top wall of each of said cavities being exposed to a grazing flow which communicates with each of said cavities through an opening formed therein for defining therewith a Helmholtz resonator, means in each of said openings and extending in each of said cavities for supporting a column of air and being equally sized, a partial wall extending from one wall partway into each of said cavities for defining subchambers and each subchamber defining a different sized volume subchamber for making each adjacent cavity acoustically asymmetrical, means acoustically coupling said adjacent cavities for tuning said liner for the frequency spectrum actually encountered and said cavities being acoustically asymmetrical so that said acoustically coupling means pumps air at a given frequency for dissipating sound energy.

2. A sound absorbing liner as defined in claim 1 including tubular members inserted into said openings and resistive material disposed in said tubular members.

* * * * *